US007057563B2

(12) United States Patent
Cox et al.

(10) Patent No.: US 7,057,563 B2
(45) Date of Patent: Jun. 6, 2006

(54) RADIATOR STRUCTURES

(75) Inventors: Gerald A. Cox, Playa Del Rey, CA (US); Mark S. Hauhe, Hermosa Beach, CA (US); Stan W. Livingston, Fullerton, CA (US); Colleen Tallman, Playa Del Rey, CA (US); Clifton Quan, Arcadia, CA (US); Anita L. Reinehr, El Segundo, CA (US); Yanmin Zhang, Cerritos, CA (US)

(73) Assignee: Raytheon Company, Waltham, MA (US)

( * ) Notice: Subject to any disclaimer, the term of this patent is extended or adjusted under 35 U.S.C. 154(b) by 0 days.

(21) Appl. No.: 10/856,443

(22) Filed: May 28, 2004

(65) Prior Publication Data

US 2005/0264448 A1 Dec. 1, 2005

(51) Int. Cl.
*H01Q 1/38* (2006.01)

(52) U.S. Cl. ..... 343/700 MS; 343/767; 343/770; 343/786

(58) Field of Classification Search ..... 343/700 MS, 343/767, 770
See application file for complete search history.

(56) References Cited

U.S. PATENT DOCUMENTS 1,689,400 A 10/1928 Manley
4,115,783 A 9/1978 Reggia
5,227,808 A 7/1993 Davis
5,313,221 A 5/1994 Denton
5,428,364 A 6/1995 Lee
5,541,611 A * 7/1996 Peng et al. ..... 343/767
5,894,288 A 4/1999 Lee
5,982,339 A * 11/1999 Lalezari et al. ..... 343/872
6,424,313 B1 7/2002 Navarro
6,476,773 B1 * 11/2002 Palmer et al. ..... 343/795
2003/0201940 A1 10/2003 Chiang
2004/0125017 A1 * 7/2004 Garcia et al. ..... 343/700 MS

OTHER PUBLICATIONS

Electromagnetic Simulation of some Common Balun Structures, K.V. Puglia, IEEE Microwave Magazine, Application Notes, pp. 56-61, Sep. 2002.
Review of Printed Marchand and Double Y Baluns: Characteristics and Application, Velimir Trifunovic and Branka Jokanovic, IEEE Transactions on Microwave Theory and Techniques, vol. 42, No. 8, Aug. 1994, pp. 1454-1462.

* cited by examiner

*Primary Examiner*—Tho Phan
(74) *Attorney, Agent, or Firm*—Leonard A. Alkov; Karl A. Vick

(57) ABSTRACT

A foldable radiator assembly includes a flexible dielectric substrate structure having a radiator conductor pattern formed therein. The flexible substrate structure can be flexible for movement between a folded position and a deployed position, or can be fixed in position by dielectric structures. An excitation circuit excites the radiator conductor pattern with RF energy. Strips of the radiator assemblies can be used to form an array aperture.

43 Claims, 12 Drawing Sheets

10
10
10
10

RADIATOR STRUCTURES

BACKGROUND

Some active array apertures are under stringent weight and space constraints. For example, space-based arrays need to be delivered into space, and so there are stringent weight and space limitations imposed by the launch vehicle capabilities. Another exemplary application involves stowing an array for battlefield deployment, e.g., when such an array is carried by a weight-sensitive transport such as a soldier.

There is a need for an array aperture that is relatively light weight. It would be an advantage to provide an array aperture which can be stored in a relatively small space.

SUMMARY OF THE DISCLOSURE

A foldable radiator assembly includes a thin, flexible dielectric substrate structure having a radiator conductor pattern formed therein. The flexible substrate structure is flexible for movement between a folded position and a deployed position. An excitation circuit excites the radiator conductor pattern with RF energy.

Strips of the radiator assemblies can be used to form an array aperture.

BRIEF DESCRIPTION OF THE DRAWINGS

Features and advantages of the disclosure will readily be appreciated by persons skilled in the art from the following detailed description when read in conjunction with the drawing wherein.

DETAILED DESCRIPTION

Figure 2:
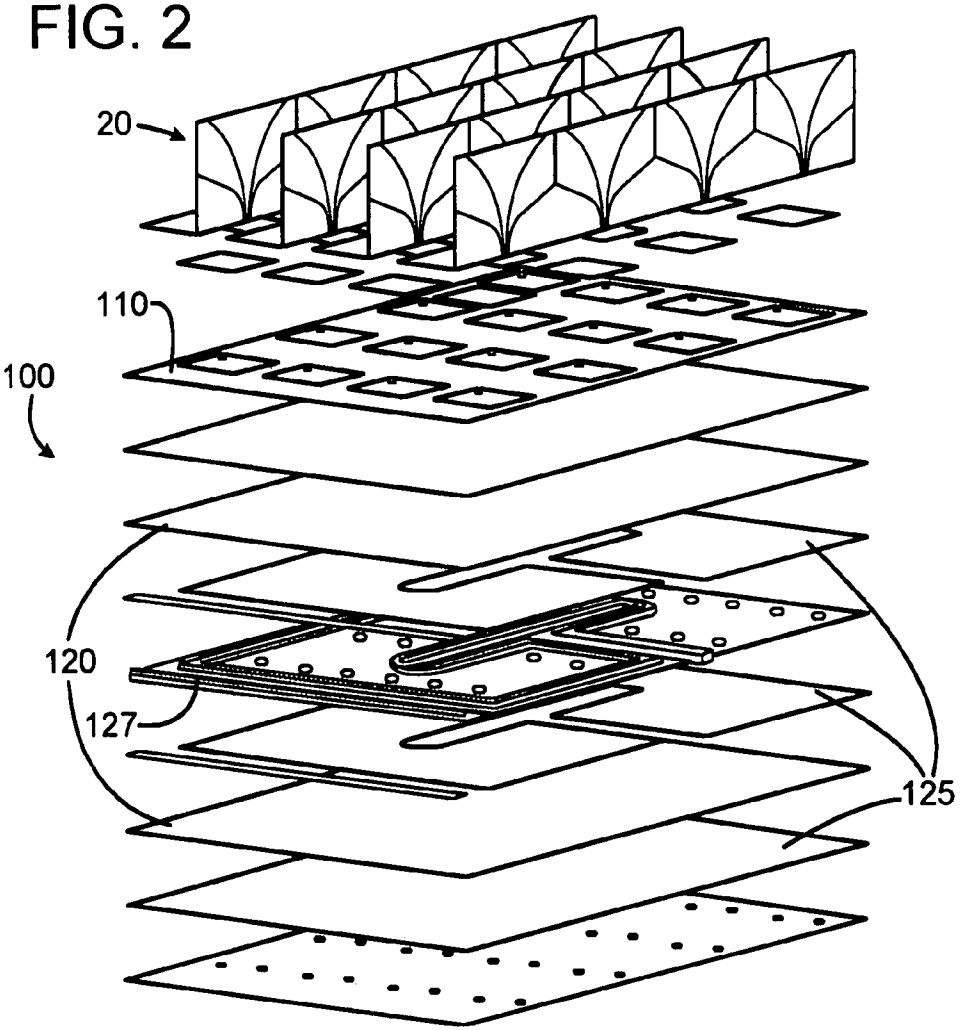
FIG. 2 is an exploded isometric view of a further exemplary embodiment of a foldable antenna array assembly.

In the following detailed description and in the several figures of the drawing, like elements are identified with like reference numerals.

Embodiments of a thin lightweight wide band radiating element and array structure are described. Exemplary applications for these embodiments include space based active array antennas. The radiator is foldable or rollable into a stored configuration for low volume storage within a rocket, for example, to increase the amount of antenna aperture that can be stored within a fixed volume, e.g. in the rocket prior to launch. When the antenna is unfolded or unrolled during deployment, the radiator may be configured to pop-up by itself to the proper operating shape and configuration, or to be deployed by a dielectric line. In other embodiments, the antenna can be fixed in position.

Figure 1:
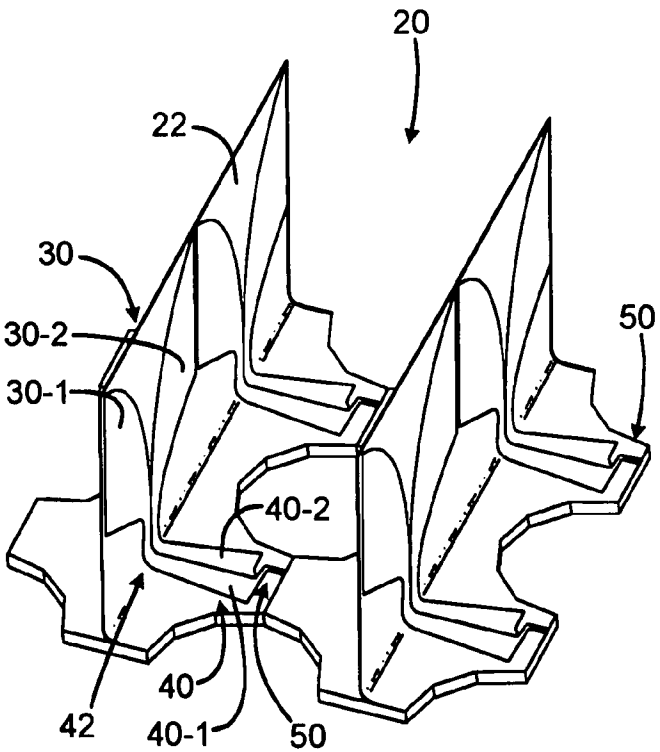
FIG. 1 is an isometric view of an embodiment of a foldable antenna array in a deployed state.

In an exemplary embodiment illustrated in FIG. 1, a radiator structure 20 includes radiator elements 30 similar to the flared dipole radiator described in U.S. Pat. No. 5,428,364, but with a coplanar strip transmission line (CPS) 40 comprising conductor strips 40-1 and 40-2 feeding the flared dipole section (including flared dipole elements 30-1 and 30-2) that incorporates a 90 degree H-plane bend 42, forming a CPS to microstrip transition 50. In an exemplary embodiment, the 90 degree H-plane bend is realized using thin, e.g. less than 4 mils thick, flexible dielectric circuit material such as polyimide, liquid crystal polymer (LCP), polyester, or duroid to form the dielectric substrate 22. The flexible circuit board material is copper cladded with the shape of the flared dipole etched onto the copper, e.g., using conventional circuit fabrication processes. A flexible dielectric layer can optionally be formed on the flexible circuit board, e.g. to add stiffness or prevent shorting if needed for a particular application.

Incorporating the 90 degree H-plane bend 42 into the CPS transmission line portion 42 of the radiator 20 allows the radiator to be easily installed into a planar multilayer active array panel antenna assembly. FIGS. 2–5A illustrate an exemplary embodiment of an exemplary assembly 100. The radiator structure 20 is mounted onto a dielectric insulator layer 110 that is laid over the antenna aperture groundplane structure 120. The groundplane structure 120 comprises a top groundplane layer 122, e.g. fabricated of a copper layer on a top surface of a top dielectric layer 126A. A lower groundplane layer 124 is formed on a bottom surface of a dielectric layer 126B. An air strip line layer 127 is assembled between the groundplane layers 122, 124 by z-axis anisotropically conductive adhesive layers 125.

Figure 4:
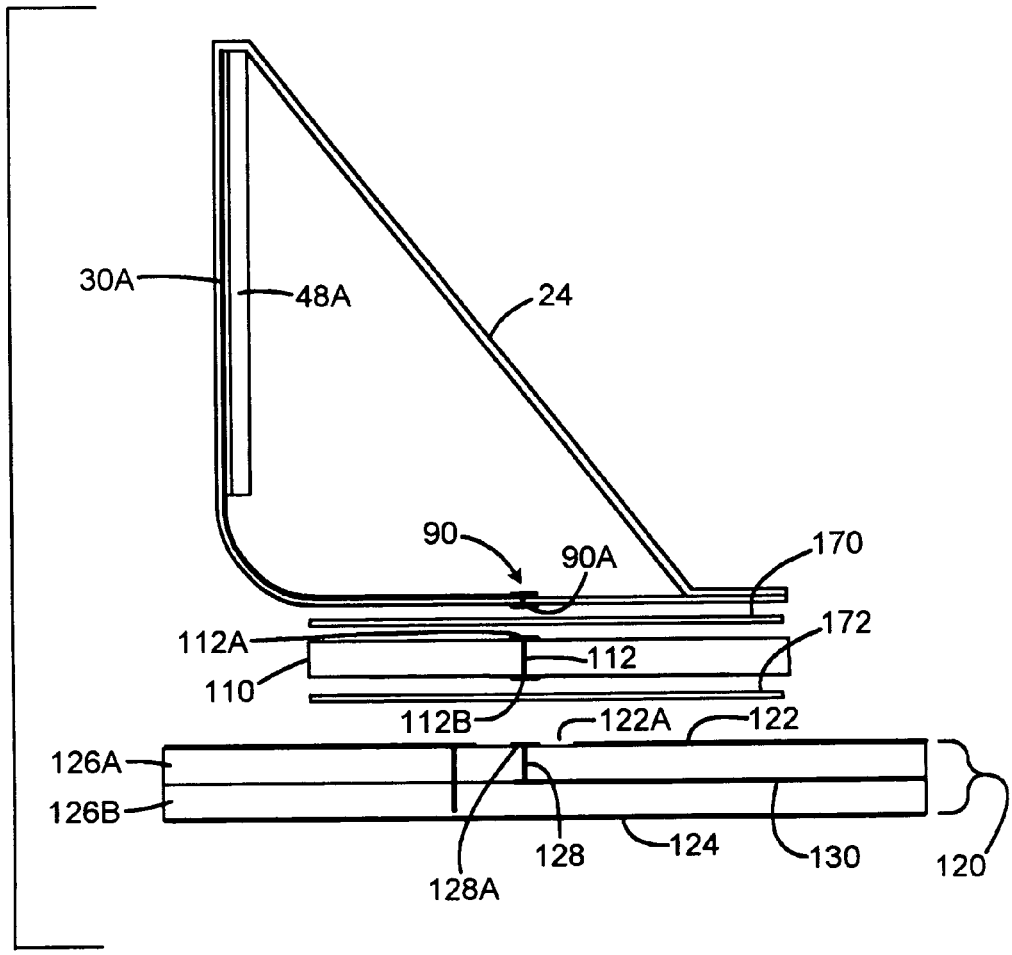
FIG. 4 is an exploded side view of an embodiment of a pop-up flare dipole radiator assembly.
Figure 5:
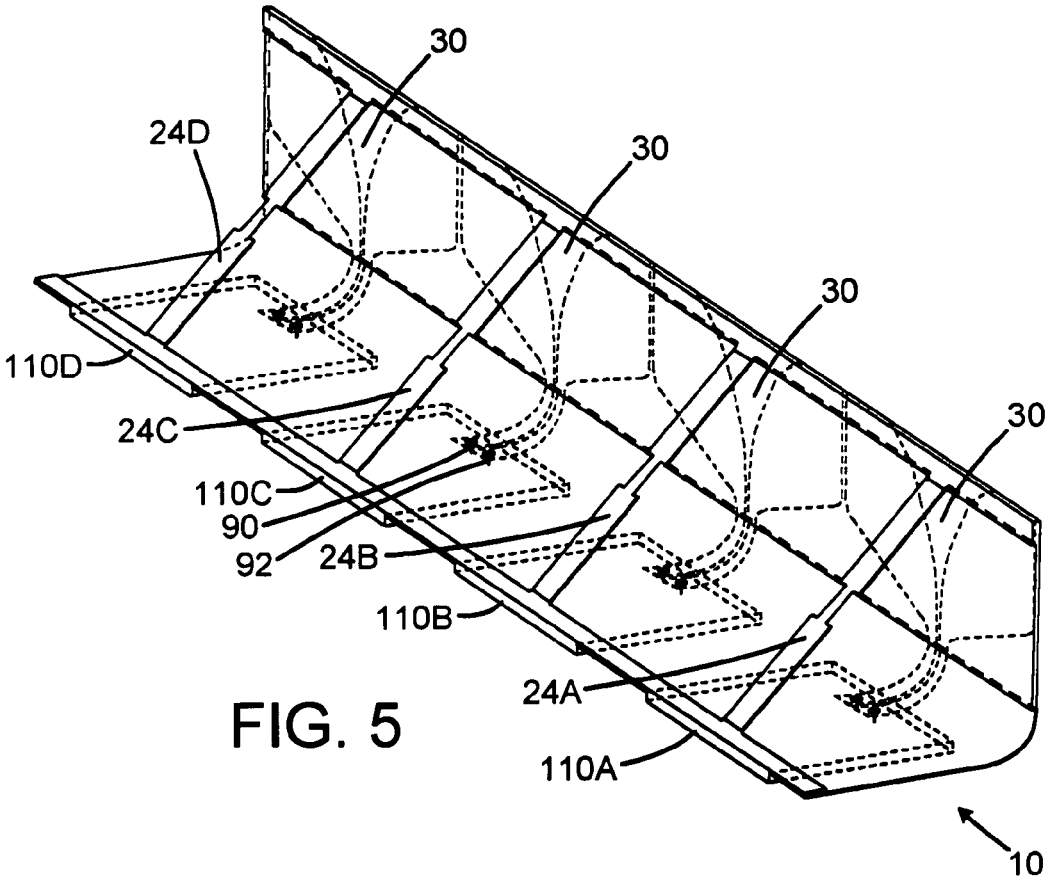
FIG. 5 is an isometric view of another embodiment of a pop-up flare dipole radiator assembly.
Figure 5A:
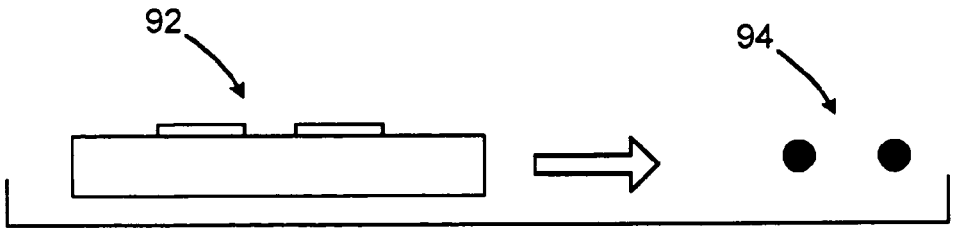
FIG. 5A is a side view illustrating the transition from a coplanar strip transmission line to 2-wire transmission line employed in the flare dipole radiator assembly of FIG. 5.

In this exemplary embodiment, the input of the coplanar strip transmission line section is orthogonally transitioned through the dielectric insulator layer 110 using plated through vias 90, 92 (FIG. 5) in the form of a 2-wire transmission line 94, as illustrated in FIG. 5A, which has a similar E-field configuration to that of the CPS transmission line. Thus, the strips 40-1, 40-2 of the CPS line are connected to respective conductive vias 90, 92. An opening or clearout 122A in the top groundplane layer 122 allows the 2-wire transmission line above the groundplane to continue through and connect to a corresponding 2-wire transmission line including stripline conductor trace 130 (FIG. 4), which then transitions orthogonally to the "balance" arms of a balun circuit, described below.

Figure 3:
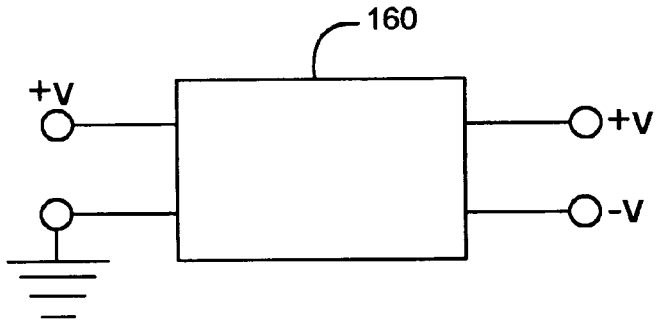
FIG. 3 is a schematic block diagram of a balun circuit.

A balun circuit 160 is used to transform single ended or "unbalanced" transmission lines, typically used for many RF devices, to double ended or "balanced" transmission lines, as illustrated in FIG. 3. Examples of unbalanced transmission lines include coaxial, microstrip, coplanar waveguide and stripline. Examples of balanced transmission lines include twin lead, 2-wire, coplanar strip and slotline. Balun circuits suitable for the purpose can be constructed by those skilled in the art. Examples of balun circuits are described, for example, in "Electromagnetic Simulation of Some Common Balun Structures," K. V. Puglia, IEEE Microwave Magazine, Application Notes, pages 56–61, September 2002; and "Review of Printed Marchand and Double Y Baluns: Characteristics and Application," Velimir Trifunovic and Branka Jokanovic, IEEE Transactions on Microwave Theory and Techniques, Vol. 42, No. 8, August 1994, pages 1454–1462.

Physical and microwave interconnect attachment of the radiator 20 to the planar antenna assembly comprising the dielectric insulator layer 110 and groundplane structure 120 is achieved using anisotropically conducting z-axis adhesive films 170, 172 (FIG. 4). Exemplary suitable commercially available anisotropically conducting z-axis adhesive films include the adhesive films marketed by 3M as part number 7373 and 9703. Catchpads 90A, 112A, 112B, 128A at the ends of the plated vias, e.g. vias 90, 112, 128 of each board layer make contact with the metal particles within the adhesive films to form a continuous DC/RF interconnect from the coplanar strip transmission line on the radiator to the stripline conductor 130 to the balun circuit 160 underneath the groundplane.

The flared dipole radiator is a combination of the flared notch radiator and dipole radiator, resulting in a wider operating frequency for a short height. An RF signal is excited across the coplanar strip at the input port of the coplanar strip transmission line. The RF signal travels across the coplanar strip at the input port of the coplanar strip transmission line. The RF signal travels along the coplanar strip across an ever increasing gap until it radiates into free space at the end of the element. The upper frequency band is limited only by the balun design. The flare dipole overcomes the lower frequency limits by having its outer conductor edge shaped in the form of a dipole. At the low frequency band edge, the flared dipole functions as a conventional dipole which is much shorter than the conventional flared notch radiator operating for the same frequency band. The 90 degree H-plane bend can be incorporated into both the conventional dipole and flared notch radiators with little impact on RF performance.

A feature of one exemplary embodiment of the radiator is its ability to fold down for low volume storage and later spring ("pop-up") to the proper operating position during deployment. In an exemplary embodiment illustrated in FIGS. 6 and 6A, for example, the 90 degree H-plane bend is realized using thin 2 mil thick flexible circuit board material such as polyimide, LCP, polyester or duroid. The 90 degree H-plane bend in the radiator acts both as a spring and a hinge. Other angular deployed positions (i.e. other than 90 degree) of the radiator may also be used, depending on the requirements of a specific application. When folded at the H-plane bend, the radiator flexible material exerts an opposing force to return it to its original flat shape. In an exemplary embodiment, slots 28 are formed in the flexible circuit board material at the hinge or fold line 25 to control the springback force, leaving areas 26 of the flexible circuit board material between the slots. Thin dielectric stiffener layers 48A, 48B are attached to the circuit board material, e.g. by non-conductive film adhesives, and provide stiffness and environmental protection. In an exemplary embodiment, the stiffener layers are 4 mil fiberglass reinforced circuit board material. Gussets 24 are used to control the radiator H-plane bending to the desired 90 degree position while the thin stiffeners also control the radiator shape. The gussets in combination with the stiffener layers are thus used to shape the radiator to the proper operating configuration.

Figure 6:
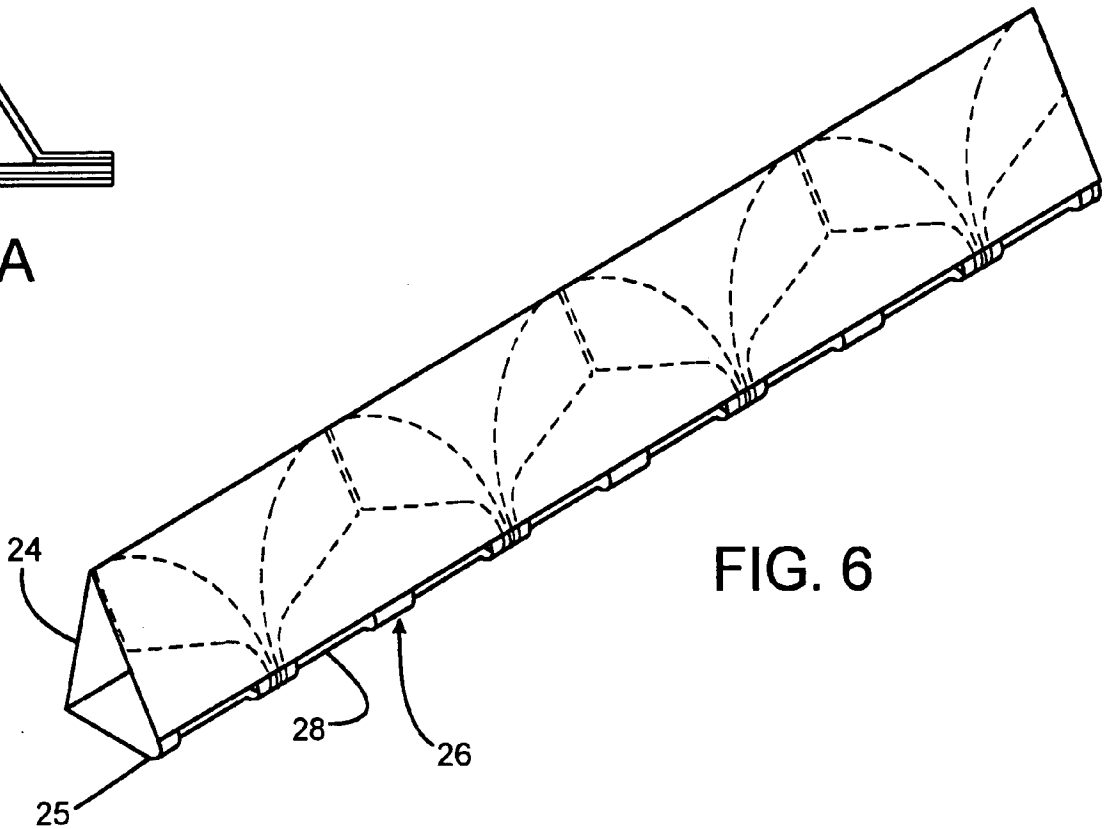
FIG. 6 is an isometric view illustrating a mechanical layout of an embodiment of a pop-up flare dipole radiator structure.
Figure 6A:
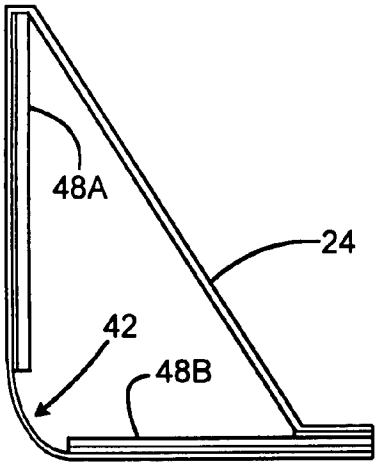
FIG. 6A is a side view of the embodiment of FIG. 6, illustrating an exemplary 90 degree deployed position.

The embodiment illustrated in FIGS. 5 and 6 is of a panel 10 fabricated from a thin sheet of flexible circuit board material, on which a plurality of flared dipole radiators 30 have been formed. Although in this example there are four radiators 30 shown, it will be appreciated that a panel with a greater number or a fewer number of radiators can be employed.

While a continuous sheet of flexible dielectric material can be used as a gusset to constrain the radiator strip, as depicted in FIG. 6, thin strips 24A–24D (FIG. 5) of flexible circuit material can also be used as gussets to position the radiator and thus eliminate potential excess material and weight. Further weight reduction can be achieved by using discrete pieces 110A, 110B, 110 C, 110D of insulating dielectric material as a spacer layer beneath the radiators, and allowing air space between the pieces, instead of a continuous dielectric layer. The feature of using thin flexible circuit board material, gussets and stiffeners for the flared dipole radiators can also be applied to the conventional discrete flared notch and dipole radiators.

Figures 7A, 7B, 7C, 7D:
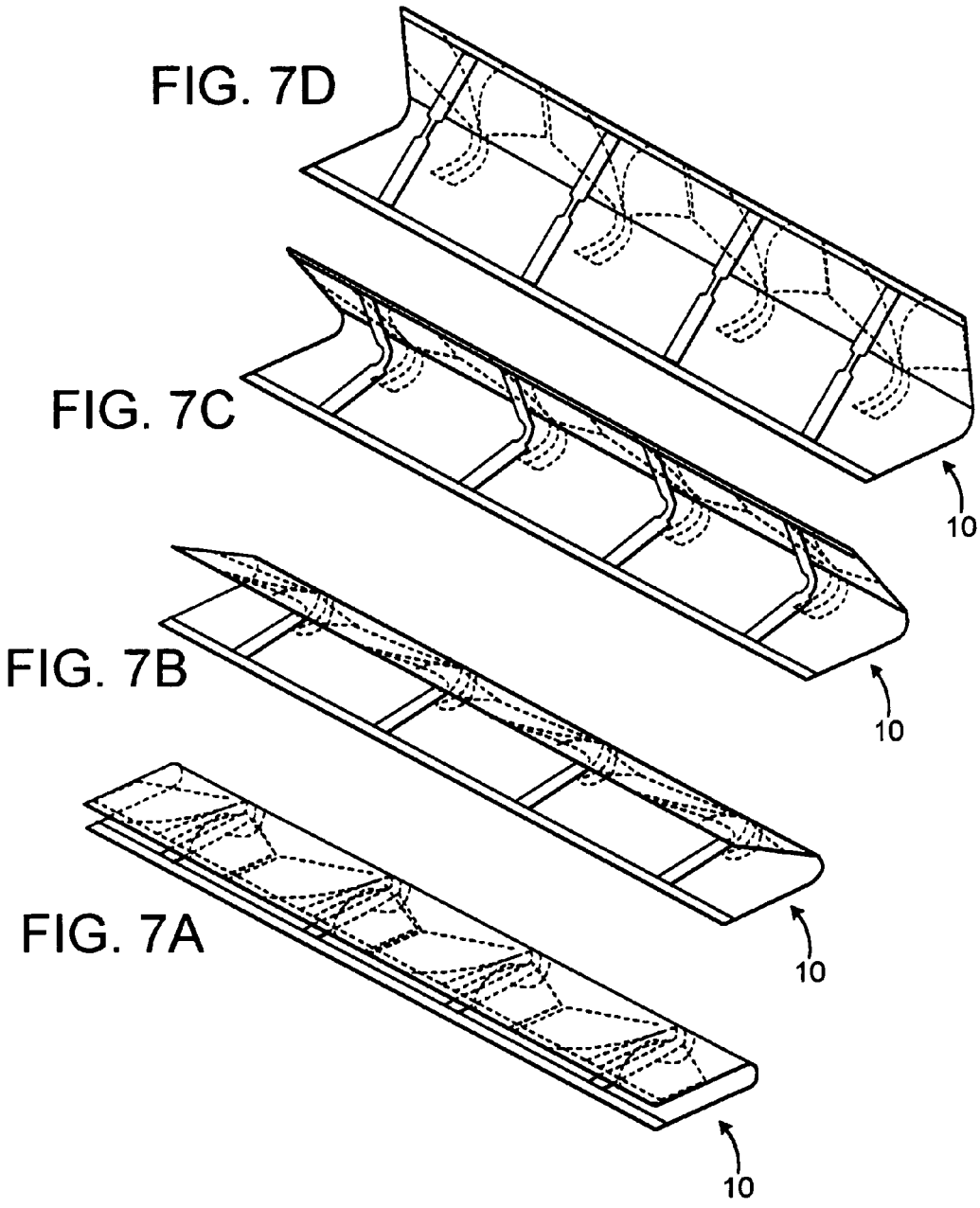
FIGS. 7A–7D illustrate in successive isometric views the folded state of the radiator structure of FIG. 6 (FIG. 7A), intermediate states (FIGS. 7B–7C), and the deployed, operating position (FIG. 7D).

FIGS. 7A–7D illustrate the radiator panel 10 in several positions. In FIG. 7A, the panel is in a folded position for storage. In FIG. 7B, the panel has started popping up, and is in a partially opened position. FIG. 7C shows the panel has moved further toward a fully deployed position. FIG. 7D shows the panel in a fully opened, deployed state, in an operating position. The stiffener and tie straps have controlled the movement of the radiator panel as it pops up from the folded position to the deployed, operating position.

Figure 8:
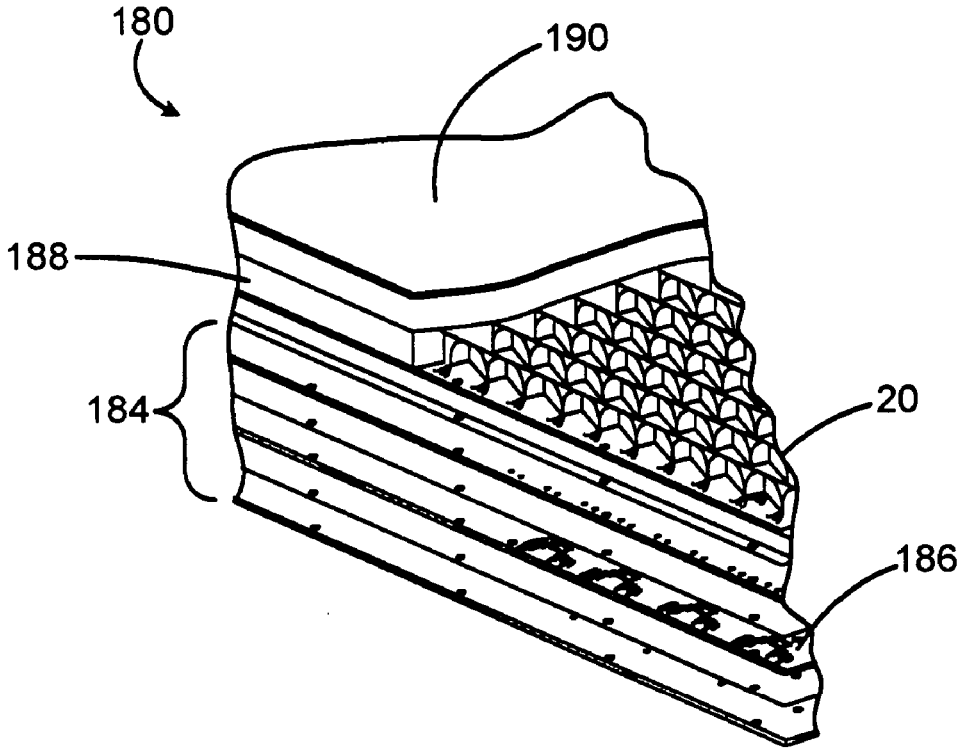
FIG. 8 is a partially broken-away fragmentary isometric view of an embodiment of an antenna array, with the flexible radiating structures in fixed positions.

FIG. 8 illustrates in an isometric cutaway view an embodiment of a panel array 180, which comprises an array of flared dipole radiator structures 20, fabricated on flexible dielectric substrates. The radiator structures 20 are supported on a laminated RF feed assembly 184, similar to the planar antenna assembly comprising the dielectric insulator layer 110 and groundplane structure 120 of FIG. 4, which includes balun circuits 186. Instead of folding, the radiator structures 20 in this embodiment are in fixed position relative to the feed assembly 184. An aperture dielectric foam encapsulant 188 encapsulates the radiator strips at edges of and between strips of the radiator assemblies to support the radiators feed structures 20 in a fixed operating position. Orthogonal strips of dielectric material can also be used to form an "egg-crate" structure to support the radiator feed structures 20 in a fixed operating position. A dielectric radome structure 190 fits over the radiator structure.

Figure 9:
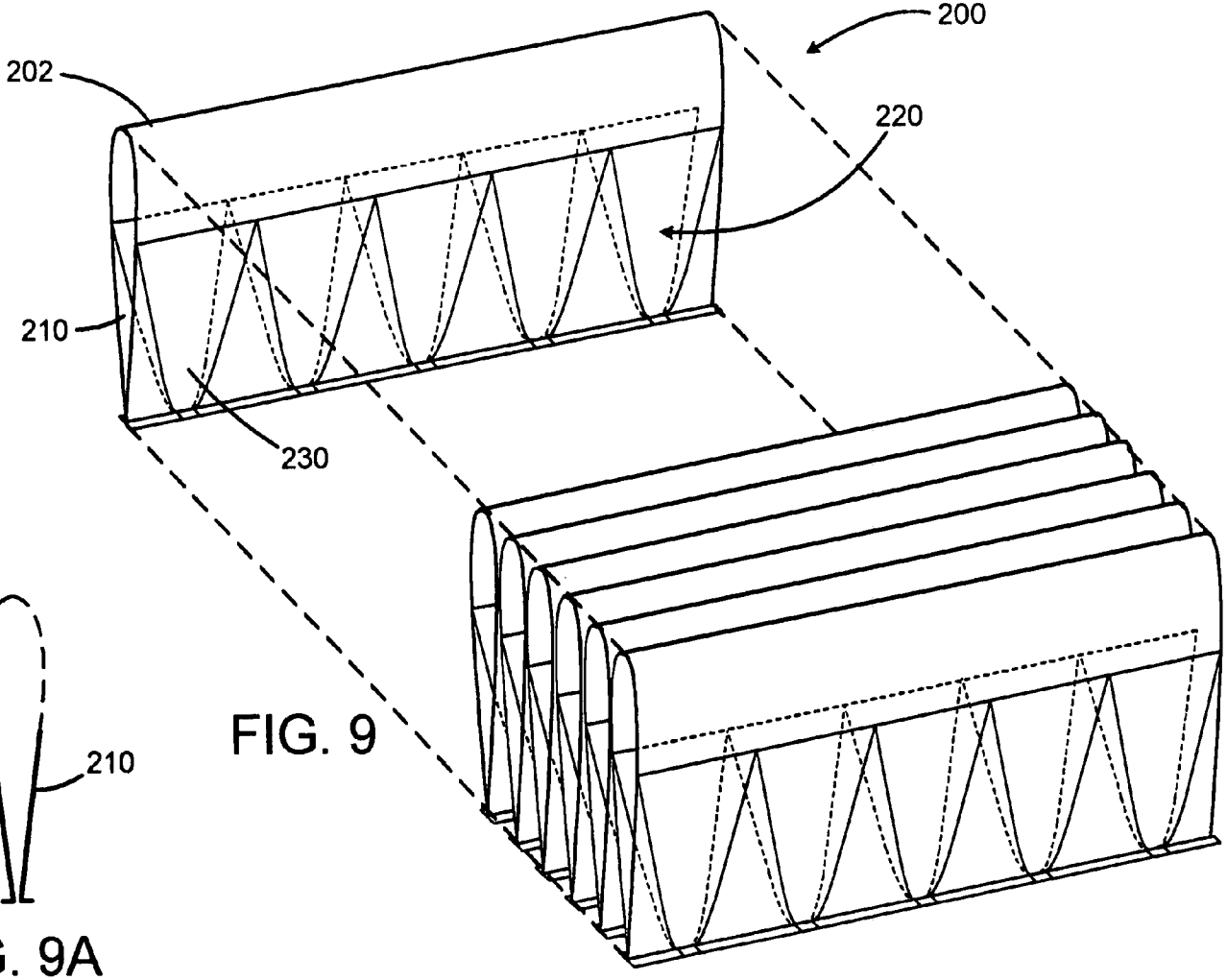
FIG. 9 is an isometric view of an embodiment of a single fold TEM horn radiator array in a deployed state.
Figure 9A:
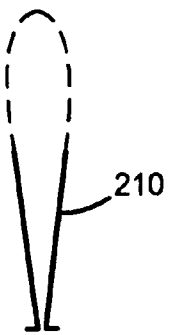
FIG. 9A is an edge view of the single fold TEM horn radiator array folded in the shape of a tear drop.
Figure 10B:
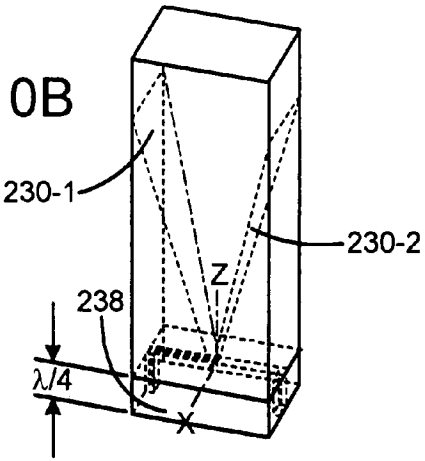
FIG. 10B is an isometric view of the TEM radiator model.
Figure 10D:
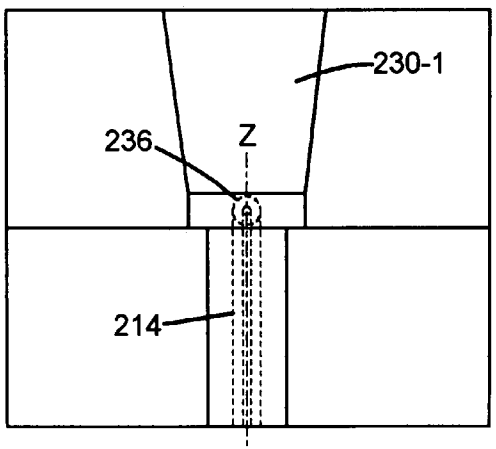
FIG. 10D is a side view of the TEM radiator model.
Figure 10A:
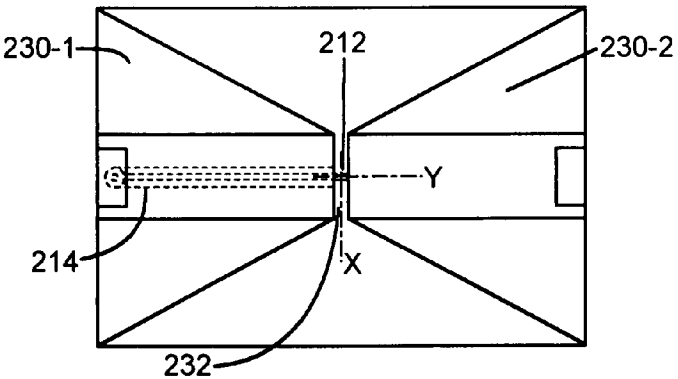
FIG. 10A is a bottom view of a TEM radiator model.
Figure 10C:
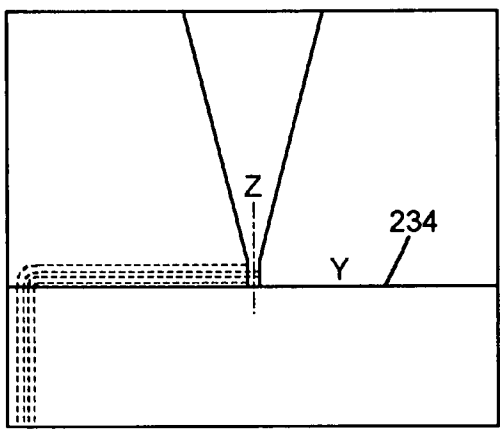
FIG. 10C is a front view of the TEM radiator model.

Another embodiment of a foldable antenna structure is shown in FIG. 9. The radiator strip 200 is fabricated as a thin single layer flexible circuit 210 folded in the shape of a tear drop, as illustrated in the edge view of FIG. 9A. The conductor pattern 220, located on the inside of the fold, is flared such that its width is widest at the radiator output while its conductor width narrows at the input port where the radiator interfaces to the RF feed or balun circuit. Likewise, the separation between the two conductor halves is widest at the radiator output while the separation narrows at the input port. The folded arch 202 at the radiator output forms and sustains the radiator shape. Since the folded arch comprises thin flexible dielectric circuit material, it has little or no impact on the RF performance of the radiator and is considered relatively invisible at microwave frequencies. The combination of the physical tear drop shape by the flexible circuit board when folded along with the flared conductor shape thus results in the realization of a wide band TEM flared horn radiator. The exemplary radiator structure 200 as illustrated in FIG. 9 has five TEM flared horn radiators 230 formed by the conductor pattern 220, although it will be understood that a greater number or a fewer number of horn radiators can be implemented in a folded radiator structure.

Figure 11:
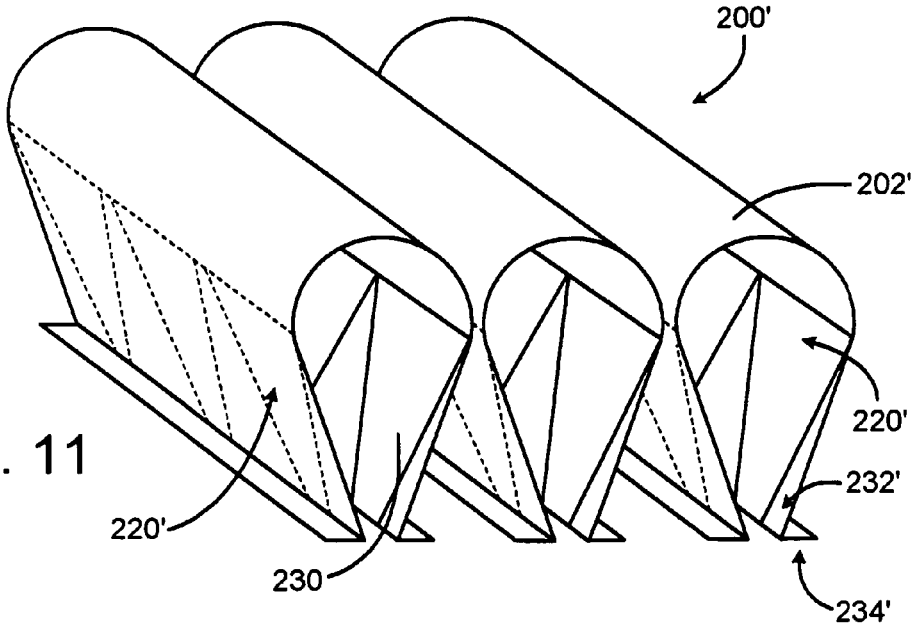
FIG. 11 is an isometric view of an embodiment of a two-dimensional antenna aperture formed by strips of foldable TEM horn radiators arrayed along the E-plane.

FIG. 9 further illustrates how a plurality of radiator strips 200 can be positioned in a side-by-side arrangement along the E-plane to provide an two dimensional aperture of TEM flared horn radiators. This is shown in further detail in FIG. 11, showing three radiator strips 200' arranged along the E-plane, each having three horns 230 defined therein to provide a 3×3 array. Each horn radiator has an RF feed port 232' at the radiator base 234'.

In an exemplary embodiment, the radiator assembly is fabricated using thin (e.g. <4 mils thick) flexible circuit board material such as polyimide, LCP, polyester, or duroid. The flexible circuit board material is copper clad with the shape of the flared dipole etched onto the copper, e.g. using conventional circuit fabrication processes.

One exemplary technique for feeding microwave energy into the radiator is illustrated in FIGS. 10A–10D. A coaxial probe 212 excites a voltage across the two halves 230-1, 230-2 of the radiator at its input port 232. The coaxial outer conductor 214 is electrically connected to one half, e.g. 230-1 using either conductive epoxy or solder while the center pin penetrates through a clearance hole 236 in the one half 230-1 to contact the opposite half 230-2 of the radiator using either conductive epoxy or solder. The back of the radiator is open circuited at its base to force the microwave signal to flow between the flare conductor patterns to the radiator output. Shielded strip line can also be used in place of the coaxial cable to excite a voltage potential across the two halves of the radiator. A groundplane 238 is positioned ¼ 8 below the base 234 of the radiator 230. Alternative techniques for driving the radiator include a balun circuit as discussed above, e.g. with respect to FIGS. 3 and 4.

As shown in FIGS. 9 and 11, a single tear drop fold of a large flexible circuit board can form several horn radiators along the H-plane. Note that this differs from conventional printed flared notch radiator strips which are formed along the E-plane. As noted above, a two dimensional array antenna aperture can be formed by arranging several radiator strips together along the E-plane as shown in FIGS. 9 and 11. This differs from the conventional printed flared notch radiator strips in which a two dimensional array antenna can be formed by arranging several radiator strips together along the H-plane.

Figure 12:
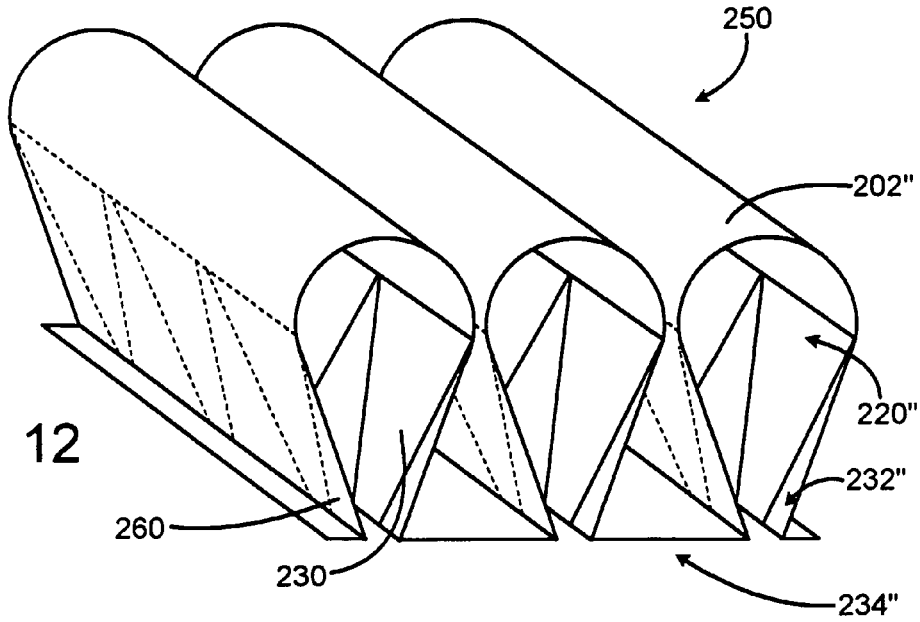
FIG. 12 is an isometric view of another embodiment of a two-dimensional antenna aperture formed by multiple folds of a continuous sheet of flexible circuit material forming TEM horn radiators.
Figure 13:
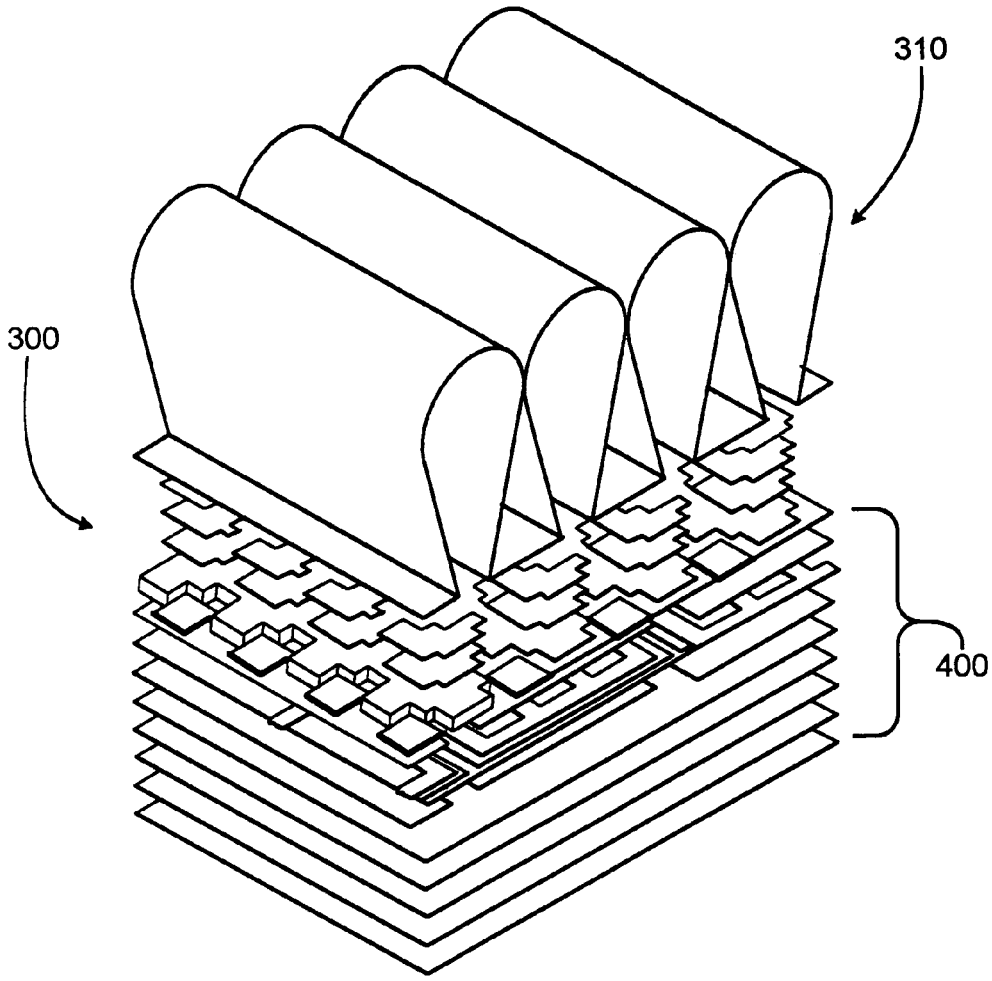
FIG. 13 is an exploded view of an embodiment of an array of printed flexible TEM horns mounted on a planar active array panel assembly.

If the sheet of flexible circuit board material is large enough, then a two dimensional array antenna aperture can be formed by incorporating several tear drop folds to realize several radiator strips along the E-plane on a single sheet. FIG. 12 illustrates an alternate embodiment of a TEM horn radiator structure 250 forming a 3×3 array of horn radiators. In this embodiment, the array is fabricated from a continuous sheet 260 of flexible circuit material, in contrast to each radiator strip being fabricated from a separate sheet of material as with the embodiment of FIG. 10. The sheet 260 has formed on an interior surface the conductor pattern 220" which defines the TEM horn radiators. The sheet is folded in such a way as to provide the folded dielectric arches 202" and the RF feed points 232" adjacent the radiator base 234". A similar spacing between strip portions along the E-plane is provided by the folding arrangement. The base 234" formed by the continuous sequential bending of horn radiator strip forms a flat/conformal surface that can mounted onto a multilayer print circuit board panel assembly containing T/R modules, circulators, storage capacitors and microwave, digital and power manifolds. The combined aperture and panel assembly thus realizes a 2-D active array antenna. An exemplary embodiment of active array antenna 300 is shown in FIG. 13, in which an array 310 of printed circuit flexible TEM horn radiators fabricated from a continuous sheet of flexible circuit material is mounted on a multilayer printed circuit board assembly 400, which functions as an RF feed, a digital and power manifold circuit. Circulators are embedded within the printed circuit assembly, and T/R modules and storage capacitors (not shown) can be mounted on the back of the assembly 400.

Because this exemplary embodiment of the radiator is constructed as a folded assembly, the radiator generates an E-plane polarization perpendicular to the plane of the base assembly 400.

Figure 14A:
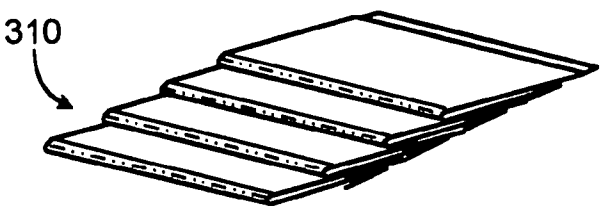
FIGS. 14A–14C diagrammatically depict the array of FIG. 13 in respective folded, partially unfolded and fully deployed states.
Figure 14B:
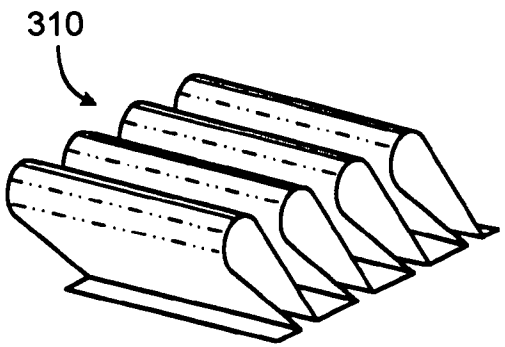
Figure 14C:
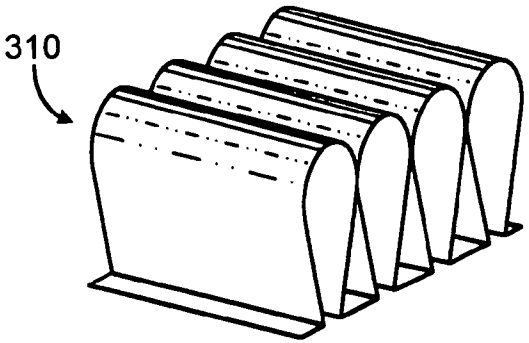
Figure 15:
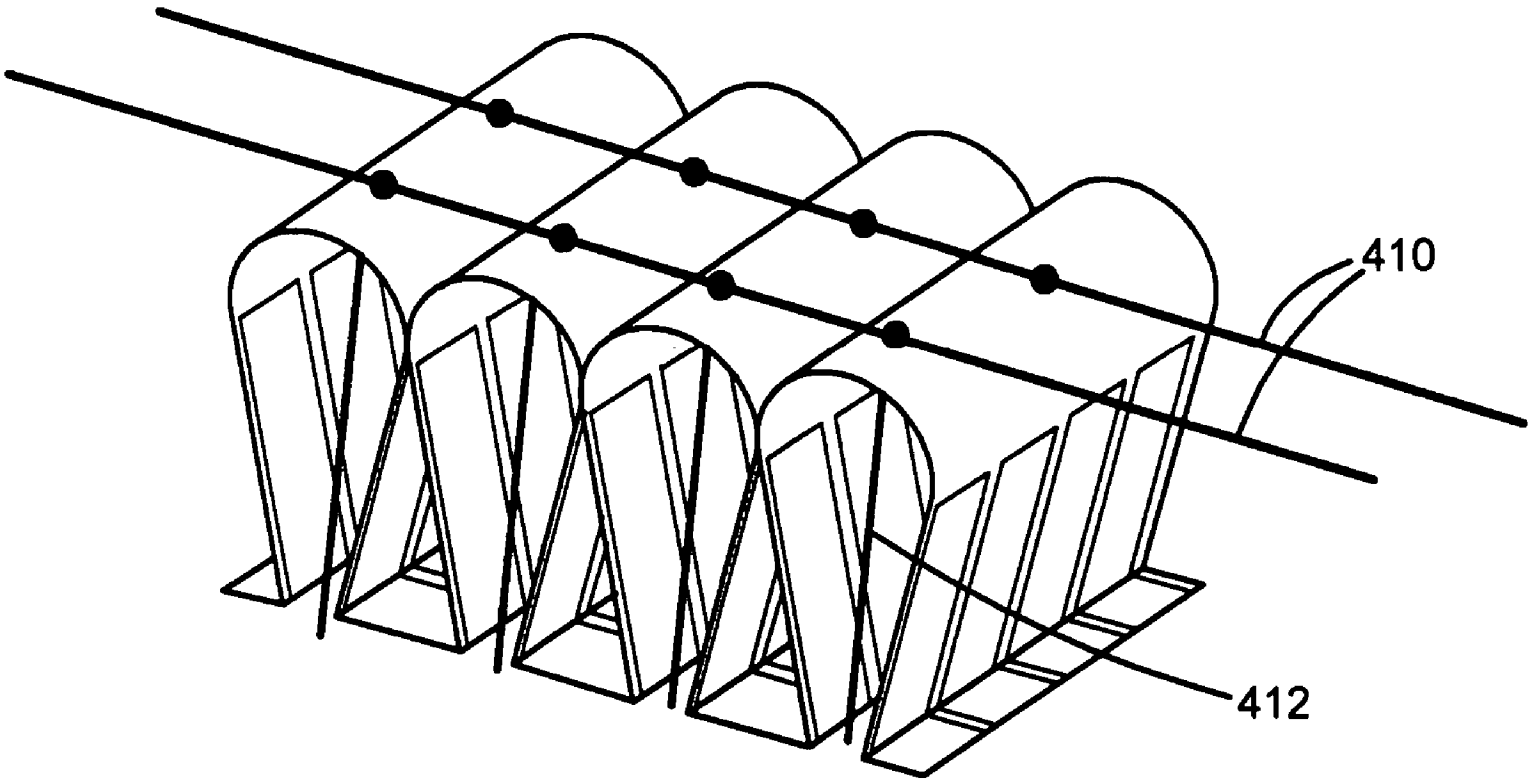
FIG. 15 is an isometric view of an embodiment of a foldable TEM horn array including a dielectric line arrangement to control radiator position.

Using thin flexible circuit material to form the radiator aperture allows the aperture to bend and flatten for low volume storage prior to deployment as illustrated in FIGS. 14A–14C, e.g. for a payload in a rocket. FIG. 14A shows the aperture 310 in a compressed, folded condition for storage. FIG. 14B shows the radiators of the aperture 310 bent to one side, and FIG. 14C shows the radiator of the aperture in a fully deployed, open state wherein the radiators are essentially perpendicular to the plane of the base. One method of controlling the radiator shape and position during the fold down and deployment is to attach fibers to the flexible circuits to push and pull the thin walls of the radiator as illustrated in FIG. 15. Here, fibers or lines 410 are bonded to the top of the arch of the radiator strips, and are fabricated of a dielectric material. The fibers 410 can be pushed/pulled to move the TEM horns from the array aperture edge, and thereby control the radiator position. Other fibers or lines 412 can be bonded to the top of the arch and to the radiator base to control the radiator shape once deployed.

Although the foregoing has been a description and illustration of specific embodiments of the invention, various modifications and changes thereto can be made by persons skilled in the art without departing from the scope and spirit of the invention as defined by the following claims.

What is claimed is:

1. A foldable radiator assembly, comprising:

a thin, flexible dielectric substrate structure having a radiator conductor pattern formed therein, the flexible substrate structure flexible for movement between a folded position and a deployed position, wherein the substrate structure has a base portion mounted to a base structure, a flexing portion which is movable with respect to the base portion, said radiator conductor pattern carried by the flexing portion, and wherein the radiator conductor pattern defines a coplanar strip transmission line which passes through a hinge area between the base portion and the flexing portion; and an excitation circuit for exciting the radiator conductor pattern with RF energy.

2. The radiator assembly of claim 1, wherein the radiator conductor pattern is a flared dipole radiator pattern.

3. The radiator assembly of claim 1, wherein the radiator conductor pattern is a TEM horn radiator pattern.

4. The radiator assembly of claim 1, wherein the excitation circuit comprises a two-wire transmission structure which is transverse to the base portion and which connects to respective conductors of the coplanar strip transmission line to form a vertical transition.

5. The radiator assembly of claim 4, further comprising a balun circuit coupled to the two-wire transition by a transmission structure transverse to the two-wire transition.

6. An antenna array, comprising:

a plurality of radiator strips, each comprising a flexible dielectric substrate structure having a plurality of radiator conductor patterns formed therein, the flexible substrate structure having a base portion mounted to an RF feed base structure, and a flexing portion which is movable with respect to the base portion in absence of restraining structures, said radiator conductor pattern carried by the flexing portion; and an excitation circuit for exciting the radiator conductor pattern with RF energy.

7. The antenna array of claim 6, wherein the radiator conductor pattern is a flared dipole radiator pattern.

8. The antenna array of claim 6, wherein the radiator conductor pattern is a TEM horn radiator pattern.

9. The antenna array of claim 6, wherein each radiator strip is fabricated on a common unitary flexible substrate structure.

10. The antenna array of claim 9, wherein all of said plurality of radiator strips are fabricated on the common unitary flexible substrate structure.

11. The antenna array of claim 6, wherein the radiator conductor pattern defines a coplanar strip transmission line which passes through a hinge area between the base portion and the flexing portion.

12. The antenna array of claim 11, wherein the excitation circuit comprises a two-wire transmission structure which is transverse to the base portion and which connects to respective conductors of the coplanar strip transmission line to form a vertical transition.

13. The antenna array of claim 11, further comprising a balun circuit coupled to the two-wire transition by a transmission structure transverse to the two-wire transition.

14. The antenna array of claim 6, wherein the plurality of radiator strips are oriented along an array H-plane and spaced along an array E-plane.

15. The antenna array of claim 14, wherein the holding means comprises a dielectric strip.

16. The antenna array of claim 14, wherein the holding means includes a dielectric flexible line.

17. The antenna array of claim 14, wherein the holding means comprises a dielectric foam between the strips to fix the positions of the radiator patterns.

18. The antenna array of claim 6, further comprising means for holding the strips in position relative to each other.

19. The antenna array of claim 6, further comprising a dielectric radome over said radiator strips.

20. A foldable, pop-up radiator assembly, comprising:

a thin, flexible dielectric substrate structure having a radiator conductor pattern formed therein, the flexible substrate structure flexible for movement between a folded position and a deployed position, the flexible substrate structure having a spring force when in the folded position tending to urge the flexible substrate structure to the deployed position such that the flexible substrate structure pops up to the deployed position when released from the folded position;

an excitation circuit for exciting the radiator conductor pattern with RF energy.

21. The radiator assembly of claim 20, wherein the radiator conductor pattern is a flared dipole radiator pattern.

22. An array aperture comprising a strip of radiator assemblies as recited in claim 21, and fabricated on a common unitary flexible substrate structure.

23. The array aperture of claim 22, wherein the strip of radiator assemblies is oriented along an array H-plane.

24. The array aperture of claim 22, further comprising a plurality of strips of the radiator assemblies, each strip oriented in parallel to the array H-plane and spaced along an array E-plane.

25. The array aperture of claim 22, wherein the radiator conductor pattern is a TEM horn radiator pattern.

26. The array aperture of claim 25, further comprising a plurality of strips of the radiator assemblies, each strip oriented in parallel to and spaced relative to other strips.

27. The radiator assembly of claim 20, wherein the radiator conductor pattern is a TEM horn radiator pattern.

28. The radiator assembly of claim 20, wherein the substrate structure has a base portion mounted to a base structure, and a flexing portion which is movable with respect to the base portion, said radiator conductor pattern carried by the flexing portion.

29. The radiator assembly of claim 28, wherein the radiator conductor pattern defines a coplanar strip transmission line which passes through a hinge area between the base portion and the flexing portion.

30. The radiator assembly of claim 29, wherein the excitation circuit comprises a two-wire transmission structure which is transverse to the base portion and which connects to respective conductors of the coplanar strip transmission line to form a vertical transition.

31. The radiator assembly of claim 29, further comprising a balun circuit coupled to the two-wire transition by a transmission structure transverse to the two-wire transition.

32. The radiator assembly of claim 28, further comprising a dielectric gusset structure connected between a distal portion of the flexing portion and the base portion to set the deployed position of the flexing portion.

33. The radiator assembly of claim 32, wherein the dielectric gusset structure comprises a dielectric strip.

34. The radiator assembly of claim 28, wherein the flexing portion joins the base portion along a hinge area of the substrate assembly, and wherein a plurality of spaced slots are formed through the dielectric substrate assembly along the joint area to control the spring force.

35. The radiator assembly of claim 28, wherein the flexible substrate structure further comprises a dielectric stiffener structure attached to said flexing portion.

36. The radiator assembly of claim 28, further comprising a dielectric line attached to said flexing portion of the substrate structure for applying a force to the flexing portion.

37. A foldable radiator assembly, comprising:

a thin, common unitary flexible dielectric substrate structure comprising a strip of radiator assemblies oriented along an array H-plane having a radiator conductor pattern formed therein, the flexible substrate structure flexible for movement between a folded position and a deployed position;

an excitation circuit for exciting the radiator conductor pattern with RF energy; and a plurality of strips of the radiator assemblies, each strip oriented in parallel to the array H-plane and spaced along an array E-plane.

38. The array aperture of claim 37, wherein the radiator conductor pattern is a TEM horn radiator pattern.

39. The array aperture of claim 38, further comprising a plurality of strips of the radiator assemblies, each strip oriented in parallel to and spaced relative to other strips.

40. A foldable radiator assembly, comprising:

a thin, flexible dielectric substrate structure having a radiator conductor pattern formed therein, the flexible substrate structure flexible for movement between a folded position and a deployed position, wherein the substrate structure has a base portion mounted to a base structure, and a flexing portion which is movable with respect to the base portion, said radiator conductor pattern carried by the flexing portion;

a dielectric gusset structure connected between a distal portion of the flexing portion and the base portion to set the deployed position of the flexing portion; and an excitation circuit for exciting the radiator conductor pattern with RF energy.

41. The radiator assembly of claim 40, wherein the dielectric gusset structure comprises a dielectric strip.

42. A foldable radiator assembly, comprising:

a thin, flexible dielectric substrate structure having a radiator conductor pattern formed therein, the flexible substrate structure flexible for movement between a folded position and a deployed position, wherein the substrate structure has a base portion mounted to a base structure, a flexing portion which is movable with respect to the base portion, said radiator conductor pattern carried by the flexing portion, wherein the flexing portion joins the base portion along a hinge areas of the substrate assembly, and wherein a plurality of spaced slots are formed through the dielectric substrate assembly along the joint area to control a spring-back force; and an excitation circuit for exciting the radiator conductor pattern with RF energy.

43. A foldable radiator assembly, comprising a thin, flexible dielectric substrate structure having a radiator conductor pattern formed therein, the flexible substrate structure flexible for movement between a folded position and a deployed position, wherein the substrate structure has a base portion mounted to a base structure, and a flexing portion which is movable with respect to the base portion, said radiator conductor pattern carried by the flexing portion;

a dielectric line attached to said flexing portion of the substrate structure for applying a deploying force to more the flexing portion to the deployed position; and an excitation circuit for exciting the radiator conductor pattern with RF energy.

* * * * *